US006131656A

United States Patent [19]

Jani

[11] Patent Number: 6,131,656

[45] Date of Patent: Oct. 17, 2000

[54] BRIDGE PLUG FOR A WELL BORE

[76] Inventor: William Jani, Site 36, Box 48, Calgary AB, Canada, T2M 4L4

[21] Appl. No.: 09/235,431

[22] Filed: Jan. 22, 1999

[30] Foreign Application Priority Data

Jan. 23, 1998 [CA] Canada ..... 2224917

[51] Int. Cl.[7] ..... E21B 33/127

[52] U.S. Cl. ..... 166/192

[58] Field of Search ..... 166/192, 285, 166/179, 387, 123, 134, 135, 118, 215, 386, 182, 138

[56] References Cited

U.S. PATENT DOCUMENTS

| | | | |
|---|---|---|---|
| 3,575,237 | 4/1971 | Malone | 166/152 |
| 3,602,305 | 8/1971 | Kisling, III | 166/134 |
| 4,018,274 | 4/1977 | Cochran | 166/182 X |
| 4,284,137 | 8/1981 | Taylor | 166/123 X |
| 4,411,435 | 10/1983 | McStravick | 166/136 X |
| 4,438,933 | 3/1984 | Zimmerman | 166/278 X |
| 4,515,213 | 5/1985 | Rogen et al. | 166/123 |
| 4,548,265 | 10/1985 | Luke | 166/140 |
| 4,693,309 | 9/1987 | Caskey | 166/123 |
| 4,697,640 | 10/1987 | Szarka | 166/182 X |
| 4,898,239 | 2/1990 | Rosenthal | 166/135 |
| 5,333,685 | 8/1994 | Gilbert | 166/123 |
| 5,441,111 | 8/1995 | Whiteford | 166/387 |
| 5,449,040 | 9/1995 | Milner et al. | 166/123 X |
| 5,613,560 | 3/1997 | Jelinski et al. | 166/387 |
| 5,667,010 | 9/1997 | Boyd et al. | 166/192 X |

FOREIGN PATENT DOCUMENTS

| | | |
|---|---|---|
| 0094169 | 11/1983 | European Pat. Off. . |
| 2155521 | 9/1985 | United Kingdom . |

*Primary Examiner*—Christopher J. Novosad
*Attorney, Agent, or Firm*—Andrus, Sceales, Starke & Sawall

[57] ABSTRACT

The present invention provides a bridge plug for use in a well bore for engagement with the wall of a tubing extending down the bore. The bridge plug includes a sealing and an anchoring mechanism slidably disposed on a mandrel. The sealing mechanism includes sealing elements which are expandable radially outwardly to engage the tubing wall when the elements are compressed. The anchoring mechanism includes first and second sleeves axially movable relative to one another and having radially inwardly sloped first and second ramps respectively. The ramps define a recess therebetween and slips having complementary ramps are received into the recess. The first and second ramps cooperate to force the anchoring member radially outwardly into engagement with the tubing wall upon axial movement of said first ramp towards said second ramp. The plug also includes a ratchet for locking the sealing mechanism and the anchoring mechanism in engagement with the tubing wall.

16 Claims, 4 Drawing Sheets

BRIDGE PLUG FOR A WELL BORE

FIELD OF THE INVENTION

The present invention relates to the field of bridge plugs for use in a well bore and, in particular, to retrievable bridge plugs used in an oil well bore.

BACKGROUND OF THE INVENTION

Bridge plugs are commonly used to isolate sections of a well, particularly where pressure differentials will result from perforating or drilling in a number of hydrocarbon formations along the well bore. These plugs can also be used to block off well bores which are no longer in use.

Retrievable bridge plugs are generally run downhole to a desired depth using a setting tool. The plugs can be run on electric lines, hydraulic lines, and solid wire lines and are set in position, for example, with an electric wireline setting assembly. The bridge plug can be retrieved using a retrieving tool on a slick line, branded line, coiled tubing or other means.

Bridge plugs generally in use today have a number of disadvantages. They are not adapted for easy use with smaller diameter tubing. When the bypass valve is released to equalize any pressure differential and clear debris in the tubing, the bridge plug also releases. Also, they require at least two trips with a running tool to release and retrieve the plug. This results in a substantial increase in the cost and man hours required to utilize the plug.

SUMMARY OF THE INVENTION

There therefore is provided a bridge plug for use in a well bore which overcomes the disadvantages of the prior art and which includes a sealing and anchoring mechanism.

The bridge plug of the present invention is retrievable in one run. It includes dual sealing and anchoring mechanisms which are not released when a bypass valve is activated to equalize any pressure differentials.

In one aspect of the present invention there is provided a bridge plug for use in a well bore for engagement with the tubing wall of the bore, said bridge plug comprising: mandrel means having an elongated body extending along a longitudinal axis and having a bore extending therethrough; sealing means disposed on said mandrel means and including sealing elements wherein the sealing elements are expandable in an outwardly direction from the longitudinal axis when said elements are compressed to engage the tubing wall; anchoring means disposed on said mandrel means and including a first and second sleeve means having radially inwardly sloped surfaces and anchoring members having a sloped surface corresponding to said sloped surfaces on said first and second sleeve means, said sloped surfaces on said first and second sleeve means cooperating to force the anchoring member radially outwardly upon movement of said first sleeve means towards said second sleeve means whereby the slip member is forced into engagement with the tubing wall; ratchet means disposed on said mandrel means for engaging said sealing means and said mandrel means; and an upper housing assembly slidably disposed on said mandrel means, said upper housing assembly movable in a downward direction along the longitudinal axis forcing said sealing elements to compress and engage the tubing wall and forcing said first sleeve towards said second sleeve.

BRIEF DESCRIPTION OF THE DRAWINGS

Preferred embodiments of the present invention may be better understood with reference to the drawings in which.

DETAILED DESCRIPTION OF THE PREFERRED EMBODIMENTS

With reference to the Figures, the present invention is a retrievable bridge plug for use in well bores and preferably in oil well bores. The bridge plug includes a dual sealing and anchoring system for engaging the pipe or tubing wall to ensure a tight fit for prevention of any pressure leaks or slippage of the plug.

The bridge plug has a longitudinal axis L, an uphole end U and a downhole end D. Each of the figures is positioned in an uphole to downhole orientation. One embodiment of the assembled plug 1 is shown in FIG. 1.

The bridge plug 1 comprises a mandrel, sleeves concentrically disposed about the mandrel along its longitudinal axis L, a sealing mechanism, an anchoring mechanism, and a ratchet assembly for releasably locking the sealing and anchoring mechanisms in engagement with the tubing wall.

Figure 1:
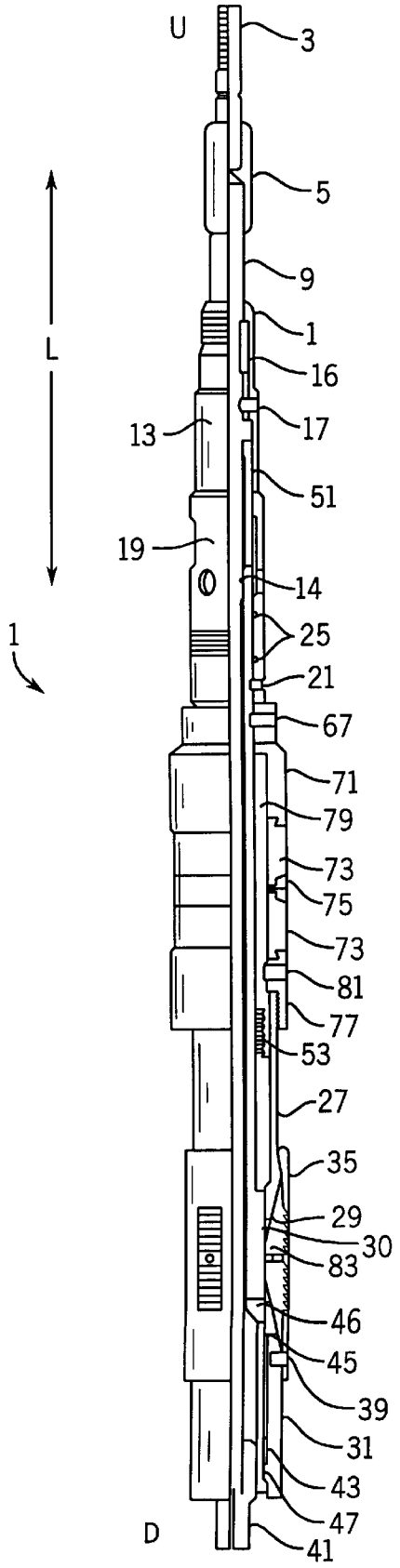
FIG. 1 is a side perspective partial cross-sectional view of one embodiment of the bridge plug of the present invention.

The bridge plug 1 has, at its uphole end U, a shear stud 3 and coupling 5, shown in FIG. 1, for attaching the plug 1 to a setting tool. The shear stud 3 comprises a short rod extending along the longitudinal axis L of the plug 1. It has threaded portions at its upper and lower ends. At or near the centre of the stud 3 is an annular groove 7. The coupling 5 is a tubular portion having internally threaded sections. The downhole threaded portion of the shear stud 3 engages the uphole threaded portion of the coupling 5. The uphole threaded portion of the shear stud 3 engages the setting tool. The setting tool attaches to the shear stud 3 and, once the plug 1 is set, as will be described in detail below, the setting tool shears off the stud 3 at the annular indentation 7 to leave the bridge plug 1 in set engagement with the tubing wall. The shear stud 3 is selected according to the pressure required to set the plug 1 and to shear the stud 3.

Figure 2:
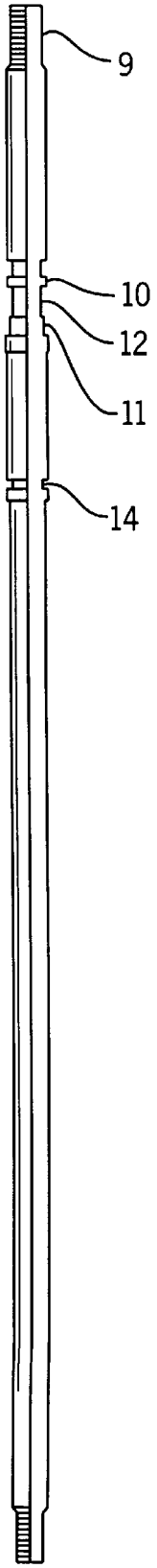
FIG. 2 is a side perspective partial cross-sectional view of the inner mandrel of the bridge plug of FIG. 1.

An inner mandrel 9 shown in FIG. 2 engages the lower end of the shear stud coupling 5. The inner mandrel 9 is an elongated tubular rod extending longitudinally L in the centre of the bridge plug 1. The inner mandrel 9 has a threaded portion at its uphole end which engages the shear stud coupling 5 and a threaded portion at its downhole end. Near its uphole end is a series of annular indentations and ribs. In particular, the inner mandrel has projections 10,11 which extend outwardly from the mandrel 9 forming a seat 12 and an annular groove 14.

A number of sleeves are concentrically disposed about the inner mandrel 9 and slidably movable thereon. These sleeves include a latch 13, bypass valve housing 19, upper cone 27, and lower cone 31.

Figure 3:
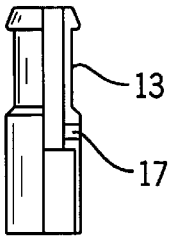
FIG. 3 is a side perspective partially cross-sectional view of the latch of the bridge plug of FIG. 1.
Figure 15:
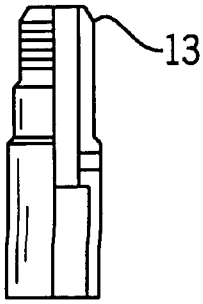
FIG. 15 is a side perspective partially cross-sectional view of an alternate latch for the bridge plug of FIG. 1.

Shown in FIG. 3 is a latch 13. An alternative embodiment incorporated into the plug of FIG. 1 is shown in FIG. 15. The latch 13 is positioned on the inner mandrel 9 below the shear stud 3 and coupling 5. It is secured to the inner mandrel 9 by shear pin 17. The latch 13 has an outwardly projecting lip 15 at its uphole end. This lip 15 engages the retrieving tool which will be described in greater detail below. In the alternative embodiment 14 shown in FIG. 15, the alternate latch 14 has a threaded portion at its upper end for engaging the retrieving tool. The alternate latch 14 requires a latch key 16 shown in FIG. 1.

Figure 4:
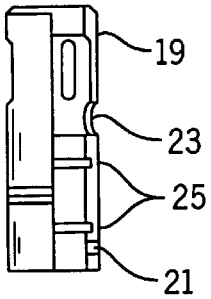
FIG. 4 is a side perspective partial cross-sectional view of the bypass valve housing of the bridge plug of FIG. 1.

Positioned below the latch 13 is the bypass valve housing 19. The housing 19, shown in FIG. 4, includes an opening 23 and grooves 25 for receiving o-rings. The housing 19 slides downward along the mandrel to an open position during the retrieving stage where the opening 23 aligns with an opening 66 in the ratchet sleeve 51, described below, to allow air, gas, or liquids to pass through an opening between the inner mandrel 9 and the ratchet sleeve 51 to equalize pressure between the uphole and downhole portions above and below the bridge plug when it is in a set position. This flow will eliminate any pressure differentials while the sealing mechanism remains set.

Figure 10:
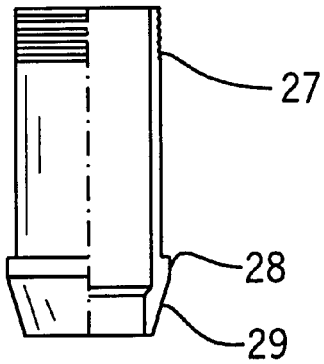
FIG. 10 is a side perspective partially cross-sectional view of the upper cone of the bridge plug of FIG. 1.
Figure 13:
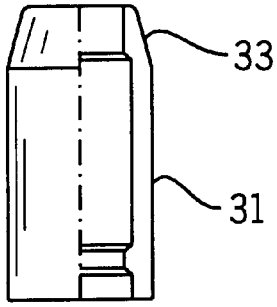
FIG. 13 is a side perspective partially cross-sectional view of the lower cone of the bridge plug of FIG. 1.

Positioned near the downhole end of the inner mandrel 9 are the upper 27 and lower cones 31 shown in FIGS. 10 and 13 respectively. These cones are also concentrically disposed about the inner mandrel 9 and slidable thereon. The upper cone 27 has a threaded portion at its uphole end. At its downhole end, it has a section with radially inwardly sloped surfaces 29 forming a ramp. The inner surface 30 of this sloped portion 29 is flat lying flush along the surface of the ratchet sleeve 51 along the longitudinal axis L of the plug 1. The outer surface forms a step portion having an annular shoulder 28. The lower cone 31 is disposed over the inner mandrel 9 downhole of the upper cone 27. It has an uphole portion with a radially inwardly sloped outer surface 33 forming a ramp. On its inner surface, the lower cone 31 has a recessed portion 43 extending between two inwardly projecting stops 45, 47 positioned one at each end of the lower cone 31. The uphole stop 45 has a flat inner surface 46 extending along the longitudinal axis L of the plug 1.

Figure 11:
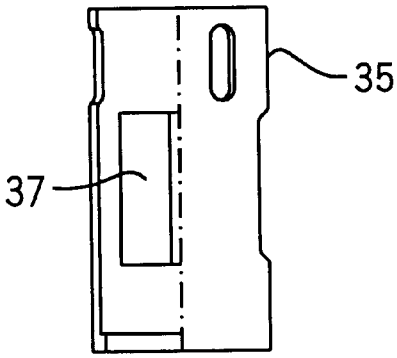
FIG. 11 is a side perspective partially cross-sectional view of the slip cage of the bridge plug of FIG. 1.

Disposed about the inner mandrel 9, extending between the upper 27 and lower cone 31, and overlapping the sloped surfaces 29, 33 of each is a slip cage 35. The slip cage 35 is shown in FIG. 11. It has an upper rim 36 extending inwardly engaging the annular shoulder 28 of the upper cone 27. It is attached to the lower cone 31 by set screw 39. The set screw 39 is positioned in a short slot on the slip cage 35 to allow the slip cage to slide downwards as the upper cone moves downward during the setting stage which will be described below. The slip cage 35 has a number of openings or windows 37.

Figure 14:
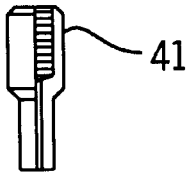
FIG. 14 is a side perspective partially cross-sectional view of the bottom sleeve of the bridge plug of FIG. 1.

Positioned at the downhole end of the inner mandrel 9 is a bottom sleeve 41 shown in FIG. 14. The bottom sleeve 41 threadedly engages the downhole end of the inner mandrel 9. The lower cone 31 extends downwardly over the uphole end of the bottom sleeve 41.

Figure 16:
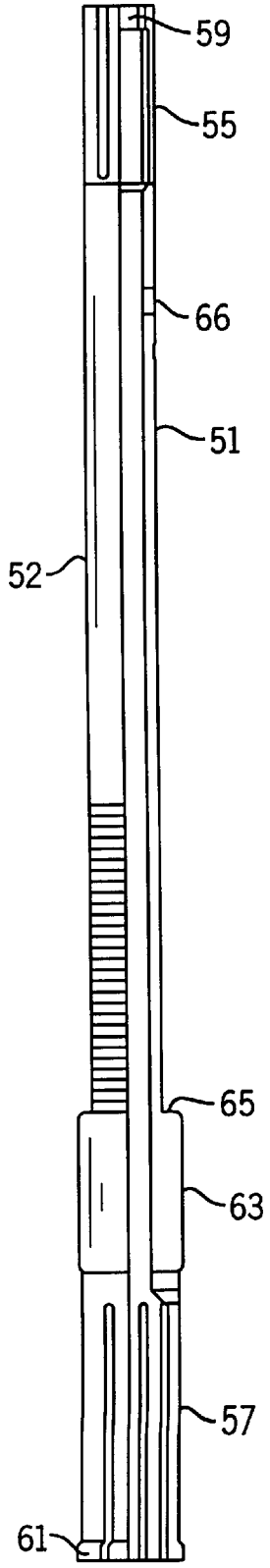
FIG. 16 is a side perspective partially cross-sectional view of the ratchet sleeve of the bridge plug of FIG. 1.

A ratchet 53 and ratchet sleeve 51 is disposed about the inner mandrel 9 and positioned between the inner mandrel 9 and the housings 13,19,27. The ratchet sleeve 51 is shown in FIG. 16. It extends along the longitudinal axis L of the plug and includes an elongated main body 52 and collets 55,57. The collets 55,57 consist of a series of flexible arms extending from the uphole and downhole ends of the main body 52. The collets 55,57 have stops 59,61 projecting from their free ends. The stops 59 on the collets 55 at the uphole end of the ratchet sleeve 51 project inwardly into the recess 12 formed between the projections 10,11 on the inner mandrel 9. The stops 61 on the collets 57 at the downhole end of the ratchet sleeve 51 project outwardly and engage the lower edge of the projection 47 on the downhole end of the lower cone 31 retaining the lower cone 31 in position. The ratchet sleeve 51 also includes a downhole portion 63 having a wider diameter than the main body 52 of the ratchet sleeve 51. It meets the main body 52 at annular shoulder 65. The main body 52 immediately above the annular shoulder 65 is threaded for engaging the ratchet 53. The ratchet sleeve 51 is attached to the bypass valve housing by shear pin 21 and to the collar 71 by shear screw 67. On the main body 52, there is an opening 66 near the uphole end. This opening 66 opens into a passage extending between the ratchet sleeve 51 and the inner mandrel 9 in the longitudinal direction L towards the downhole end of the bridge plug 1. In the assembled plug, prior to setting, opening 66 lies between grooves 25. During the retrieving stage, the housing 19 is moved in a downward direction and the opening 23 in the housing 19 will communicate with opening 66 to allow the flow of air, gas, and/or liquids from above and below the set bridge plug to equalize the pressure before the plug is removed.

The ratchet 53 is concentrically disposed about the ratchet sleeve 51. It threadedly engages the ratchet sleeve 51 and rubber mandrel 79 and locks the sealing mechanism in a set position as will be described in greater detail below.

The plug 1 includes a sealing mechanism. The sealing mechanism includes a collar 71, elements 73, spacer 75, element seat 77, and a rubber mandrel 79.

Figure 5:
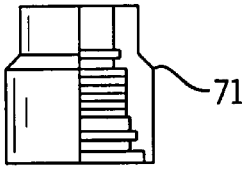
FIG. 5 is a side perspective partially cross-sectional view of the collar of the bridge plug of FIG. 1.

The collar 71 is shown in FIG. 5. It is slidably disposed about the inner mandrel 9 and the ratchet sleeve 51. The uphole end of the collar 71 engages the downhole end of the bypass valve housing 19. Its downhole portion has a larger diameter than the uphole end and includes an internally threaded portion. The collar 71 is attached to the ratchet sleeve 51 by shear screw 67.

Figure 6:
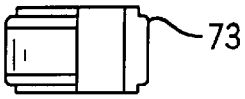
FIG. 6 is a side perspective partially cross-sectional view of the element of the bridge plug of FIG. 1.
Figure 7:
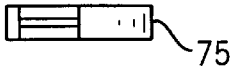
FIG. 7 is a side perspective partially cross-sectional view of the spacer of the bridge plug of FIG. 1.

Disposed about the inner mandrel 9 and the ratchet sleeve 51 below the collar are the elements 73. The elements 73 are comprised of any suitable material, for example rubber, which, when compressed, will expand outwardly into tight engagement with the tubing wall. In FIG. 1, the plug 1 includes two elements 73 separated by a spacer 75. These are shown in more detail in FIGS. 6 and 7.

Figure 8:
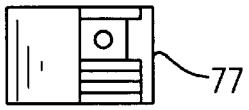
FIG. 8 is a side perspective partially cross-sectional view of the element seat of the bridge plug of FIG. 1.

The element seat 77 is shown in FIG. 8 and is beneath the lower element and disposed slidably about the inner mandrel 9 and the ratchet sleeve 5 1. The element seat 77 provides a base for the element 73. It has an internally threaded portion at its downhole end for engaging the threaded portion of the uphole end of the upper cone 27.

Figure 9:
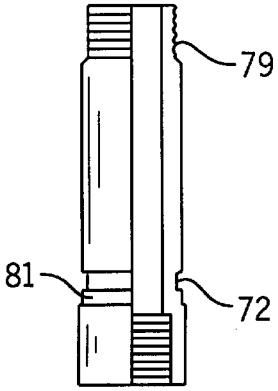
FIG. 9 is a side perspective partial cross-sectional view of the rubber mandrel of the bridge plug of FIG. 1.
Figure 12:
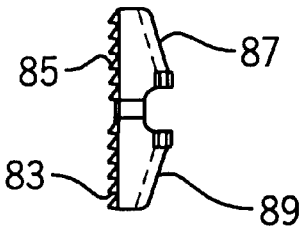
FIG. 12 is a side perspective partial cross-sectional view of a slip of the bridge plug of FIG. 1.

The rubber mandrel 79 is disposed about the ratchet sleeve 51 and positioned longitudinally between the ratchet sleeve 51 and the collar 71, elements 73, spacer 75, element seat 77, and uphole end of the upper cone 27. It is shown in FIG. 9. It has uphole and downhole threaded portions. The uphole threaded portion engages the internally threaded portion of the collar 71. The downhole threaded portion engages the ratchet 53. At the downhole portion of the rubber mandrel is a series of stepped indentations 72. When the bridge plug is inserted into the well bore, the stepped indentations 72 are positioned above the lower threaded portion of the element seat 77 at the shear screw 81. The shear screw 81 attaches the element seat 77 to the rubber mandrel The anchoring system is located near the downhole end of the plug 1. It includes the upper 27 and lower cones 31, and slip cage 35 already described. It also includes slips 83 shown in FIG. 12. The slips 83 are mounted on the portion 63 of the ratchet sleeve 51 and biased inwardly by slip springs. In an anchored position, the slips 83 extend outwardly through the windows 37 in the slip cage 35. The slips 83 have an outer surface 85 for engaging the tubing wall in a set position. The outer surface may be serrated or utilize other means to maintain a solid anchor on the tubing wall. The inner surface of the slips 83 includes two sloped surfaces 87,89. These sloped surfaces 87,89 correspond to the outer sloped surfaces 29,33 of the upper 27 and lower cones 31.

SETTING STAGE

To set the bridge plug 1 in engagement with the tubing wall, a setting tool is used. The setting tool may include an electric wireline setting assembly, solid wireline setting assembly, or a hydraulic setting assembly, however, any suitable tool known in the art may be used.

Before the bridge plug is inserted into the well bore, the setting tool attaches to the bridge plug 1 by threadedly engaging the shear stud 3 at its uphole end U. A sleeve on the setting tool extends over the uphole portion of the plug 1 and contacts the uphole portion of the collar 71. The setting tool and the plug 1 are run into the well bore and lowered to the desired depth to be set. The plug is preferably set using an electric or hydraulic charge.

The setting tool sleeve uses pressure to force the collar 71 downwards. At the same time, the shear stud 3 remains attached to the setting tool and, since the inner mandrel 9 is attached to the shear stud, the mandrel 9 remains relatively stationary along with the ratchet sleeve.

As the collar 71 is forced downwards, the shear pin 21 is sheared allowing the collar 71 to move in a downward direction. This force causes other downhole components such as the elements 73, element seat 77, and upper cone 27 to move downwards as well. When sufficient force is applied, preferably after the anchoring mechanism is set, the shear screw 81 also shears.

As the upper cone 27 moves downwards, the sloped surface 29 on its downhole end engages the sloped surface 87 on the slips 83. At the same time, the slips 83 are forced downward and the sloped surface 89 on the slips 83 engages the sloped surface 33 of the lower cone 31. In this manner, the slips 83 are forced outwards and into tight anchoring engagement with the tubing wall. As the pressure from the setting tool increases, the slips 83 are forced into tighter engagement with the tubing wall to provide a solid anchor for the plug 1.

As the anchoring mechanism is setting or immediately thereafter, the sealing mechanism also sets. When the anchoring mechanism is set, shear screw 81 shears. The collar 71 is connected by threaded engagement to the rubber mandrel 79. The downward movement of the collar 71 causes a downward force on the rubber mandrel 79 moving it downward. The downhole end of the rubber mandrel 79 is connected to ratchet 53 which will correspondingly move in a downward direction along the ratchet sleeve 51 causing the stepped portions 72 of the rubber mandrel to move below the position of the shear screw 81 as the rubber mandrel 79 is displaced. The force of the setting tool will compress the elements 73 forcing them to expand outwardly into sealing engagement with the tubing wall. As the pressure on the collar 71 increases and the ratchet pulls the rubber mandrel 79 in a downwards direction, the elements 73 will form a tighter seal against the tubing wall.

When the pressure reaches a predetermined level, the shear stud 3 will shear at the annular groove 7 thereby releasing the bridge plug 1 from the setting tool. The ratchet 53 will maintain the rubber mandrel 79 in its downward position drawing the collar downward and compressing the elements 73 forcing them outwards to maintain their engagement with the tubing wall. The position of the ratchet 53 and the rubber mandrel 79 also maintains the downward position of the upper cone 27 forcing the slips 73 into anchoring engagement with the tubing wall. The setting tool may now be removed from the well bore and the bridge plug 1 remains in the well bore in sealed and anchored engagement with the tubing wall.

The pressures at which the shear screws, pins and shear studs shear is predetermined and can be altered by varying the strength of these components. For example, it is preferred that shear screw 69 shears at approximately 1000 lb of pressure. Screw 81 will shear at approximately 6000 lb of pressure. The pressure created by the setting tool may reach as high as 18000 lb of pressure. At that point, the shear stud will shear releasing the plug from the setting tool. However, the strength of these components may be altered to allow them to shear at any desired pressure load.

RETRIEVING STAGE

To retrieve the plug from a well bore, a retrieving tool is used. Any suitable retrieving tool known in the art may be used. The tool may be run downhole on a wireline, tubing, or other manner known in the art.

The releasing tool slides over the uphole end of the set plug 1 and contacts the bypass valve housing 19. The tool forces the housing 19 downwards. This force causes the shear pin 21 to shear allowing the housing 19 to move downwards. This movement will allow the opening 23 in the housing 19 to line up with opening 66 in the ratchet sleeve 51. The opening 66 in the ratchet sleeve 51 connects to an opening extending between the inner mandrel 9 and the ratchet sleeve 51 along the longitudinal length to the downhole end of the plug 1. This passage and opening 23 allows gas and/or liquid to pass from the sections of the tubing above and below the set bridge plug to equalize the pressure. The plug 1 remains set in the well bore. This release of pressure will clear any debris from around the plug 1 and will allow the plug 1 to be safely removed from the well bore.

Once the pressure has been equalized, the retrieving tool will connect to the latch 13 and move it in an upwards direction. Shear pin 17 will shear allowing the latch to move upwards. Once the latch 13 has moved upwards past the uphole end of the collets 55 on the ratchet sleeve 51, the stops 59 on the collets 55 are released from the seat 12 on the inner mandrel 9. The ratchet sleeve 51 is no longer held in position in relation to the inner mandrel 9 and it will move downwards. As the ratchet sleeve 51 moves downwards, the downward pressure on the rubber mandrel 79 is relieved and the elements 73 will retract from the tubing wall to return to their relaxed position. The sealing mechanism is now released.

At the same time or immediately thereafter, as the ratchet sleeve 51 moves in a downward position, the stops 61 on the downhole end of the collets 57 also move in a downward direction. The stops 61 will move downhole of the bottom sleeve and allow the lower stops 47 to be released from the collet stops 61. This movement allows the lower cone 31 to move downwards disengaging its sloped surface 33 from the sloped surface 89 of the slips 83. The slips 83 will move downwards with the ratchet sleeve 51 and therefore their uphole sloped surface 87 will disengage the sloped surface 29 of the upper cone 27. The slip springs will bias the slips towards the ratchet sleeve 51 and into a retracted position away from the tubing wall. The anchoring mechanism is now released and the bridge plug can be raised out of the well bore.

The above-described embodiments of the present invention are meant to be illustrative of preferred embodiments and are not intended to limit the scope of the present invention. Variations of the invention will be readily apparent to persons skilled in the art and may be made without departing from the spirit or scope of the invention. These variations are intended to be within the scope of the present invention. The only limitations to the scope of the present invention are set out in the following appended claims.

What is claimed is:

1. A bridge plug for use in a well bore for engagement with the wall of a tubing extending down the bore, said bridge plug comprising:

a mandrel having an elongated body extending along a longitudinal axis of the tubing;

sealing means disposed on said mandrel for sealingly engaging the tubing wall, said sealing means including at least one sealing element wherein said sealing element is expandable radially outwardly to engage the tubing wall when said element is compressed;

anchoring means for locking the bridge plug in the tubing, said anchoring means being disposed on said mandrel and including first and second sleeves being axially movable relative to one another and having radially inwardly sloped first and second ramps respectively, said ramps defining a recess therebetween; and at least one anchoring member fitting said recess and having complementary sloped ramps; said first and second ramps cooperating to force said anchoring member radially outwardly into engagement with the tubing wall upon axial movement of said first ramp towards said second ramp;

ratchet means disposed on said mandrel for locking said sealing means and said anchoring means in engagement with the tubing wall;

an upper housing assembly axially slidably disposed on said mandrel, at least a portion of which is slidable towards said anchoring means and said sealing elements for compressing said sealing elements into engagement with the tubing wall and for moving said first ramp towards said second ramp forcing said anchoring members into anchoring engagement with said tubing wall, the upper housing assembly being shaped and constructed to unlock said ratchet means and disengage said sealing elements and the anchoring members upon axial movement of at least a portion of said housing assembly away from the anchoring means.

2. The plug of claim 1 wherein said sealing means includes two or more axially adjacent sealing elements disposed coaxially about the mandrel; spacers disposed therebetween; and an element seat disposed below said sealing elements for providing a base for compression of said sealing elements.

3. The plug of claim 2, wherein said upper housing assembly includes a collar means disposed about said mandrel in engagement with said at least one sealing element wherein movement of said collar means towards said element seat compresses said sealing element against said element seat and into engagement with the tubing wall.

4. The plug of claim 3, wherein movement of said collar means towards said element seat moves said first ramp towards said second ramp forcing said anchoring member radially outwardly into engagement with the tubing wall.

5. The plug of claim 4, wherein said ratchet means includes a ratchet sleeve disposed about said mandrel, a rubber mandrel disposed about said ratchet sleeve and connecting to said collar means, and a ratchet disposed about said ratchet sleeve and engaging said ratchet sleeve and said rubber mandrel, said movement of said collar means towards said element seat causing said ratchet to move along said ratchet sleeve away from said collar means drawing said rubber mandrel along with said ratchet thereby locking said collar means in a position compressing said sealing elements into engagement with the tubing wall and locking said anchoring members in engagement with the tubing wall.

6. The plug of claim 5, further including a bypass valve including a passage through said plug for allowing the flow of fluid between an area above said sealing means and below said anchoring member; and an opening in said upper housing assembly, said opening movable between a closed position where said opening is not in fluid communication with said passage and an open position where said opening is in fluid communication with said passage allowing fluid to flow through said passage between said area above said sealing means and below said anchoring member.

7. The plug of claim 6, wherein said sealing means includes two or more sealing elements disposed axially about the mandrel along the longitudinal axis; spacers disposed therebetween; and an element seat disposed below said sealing elements for providing a base for compression of said sealing elements.

8. The plug of claim 7, wherein said upper housing assembly includes a collar means disposed about said mandrel in engagement with said at least one sealing element wherein movement of said collar means towards said element seat compresses said sealing element into engagement with the tubing wall.

9. The plug of claim 8, wherein movement of said collar means towards said element seat moves said first sleeve towards said second sleeve forcing said anchoring member radially outwardly into engagement with the tubing wall.

10. The plug of claim 9, wherein said ratchet means includes a ratchet sleeve disposed about said mandrel means, a rubber mandrel disposed about said ratchet sleeve and connecting to said collar means, and a ratchet disposed about said ratchet sleeve and engaging said ratchet sleeve and said rubber mandrel, said movement of said collar means towards said element seat causing said ratchet to move along said ratchet sleeve away from said collar means drawing said rubber mandrel along with said ratchet thereby locking said collar means in a position compressing said sealing elements into engagement with the tubing wall and locking said anchoring members in engagement with the tubing wall.

11. A bridge plug for use in a well bore for engagement with the wall of a tubing extending down the bore, said bridge plug comprising:

a mandrel having an elongated body extending along a longitudinal axis of the tubing;

sealing means disposed on said mandrel for sealingly engaging the tubing wall and including sealing elements expandable radially outwardly to engage the tubing wall when said elements are compressed;

anchoring means for locking the bridge plug in the tubing, said anchoring means being disposed on said mandrel and including an upper sleeve axially slidable on said mandrel and having a first radially inwardly sloped ramp, a lower sleeve disposed on said mandrel and axially slidable in relation to said upper sleeve, said lower sleeve having a second radially inwardly sloped ramp, said first and second radially inwardly sloped ramps defining a recess therebetween;

at least one slip positioned between said upper and lower sleeve and received into said recess, said slip having complementary sloped ramps; said first and second sloped ramps cooperating to force said slip radially outwardly into engagement with the tubing wall upon axial movement of said upper sleeve towards said lower sleeve;

ratchet means disposed on said mandrel for locking said sealing means and said anchoring means in engagement with the tubing wall;

an upper housing assembly axially slidably disposed on said mandrel at least a portion of which is movable towards said sealing elements and anchoring means for compressing said sealing elements into engagement with the tubing wall and for moving said upper sleeve towards said lower sleeve thereby forcing said slip into anchoring engagement with the tubing wall; said upper housing assembly being shaped and constructed to unlock the ratchet means and disengage the anchoring means and the sealing means upon axial movement of at least a portion of said upper housing assembly away from said anchoring means.

12. The plug of claim 11, further including a bypass valve including a passage through said plug for allowing the flow of fluid between an area above said sealing means and below said slip; and an opening in said upper housing assembly, said opening movable between a closed position where said opening is not in fluid communication with said passage and an open position where said opening is in fluid communication with said passage allowing fluid to flow through said passage between said area above said sealing means and below said slip.

13. The plug of claim 11, wherein said sealing means includes two or more sealing elements disposed axially about the mandrel along the longitudinal axis; spacers disposed therebetween; and an element seat disposed below said sealing elements for providing a base for compression of said sealing elements.

14. The plug of claim 13, wherein said upper housing assembly includes a collar means disposed about said mandrel in engagement with said at least one sealing element wherein movement of said collar means towards said element seat compresses said sealing element into engagement with the tubing wall.

15. The plug of claim 14, wherein movement of said collar means towards said element seat moves said first sleeve towards said second sleeve forcing said slip radially outwardly into engagement with the tubing wall.

16. The plug of claim 15, wherein said ratchet means includes a ratchet sleeve disposed about said mandrel means, a rubber mandrel disposed about said ratchet sleeve and connecting to said collar means, and a ratchet disposed about said ratchet sleeve and engaging said ratchet sleeve and said rubber mandrel, said movement of said collar means towards said element seat causing said ratchet to move along said ratchet sleeve away from said collar means drawing said rubber mandrel along with said ratchet thereby locking said collar means in a position compressing said sealing elements into engagement with the tubing wall and locking said anchoring members in engagement with the tubing wall.

* * * * *